US005365037A

United States Patent [19]

Chan

[11] Patent Number: 5,365,037

[45] Date of Patent: Nov. 15, 1994

[54] ELECTRICALLY HEATED-AIR CURLING IRON WITH A PLURALITY OF DIFFERENT DIAMETER HAIR ROLLERS USABLE THEREWITH

[75] Inventor: Wing K. Chan, Kowloon, Hong Kong

[73] Assignee: America Direct (HK) Ltd., Kowloon, Hong Kong

[21] Appl. No.: 896,135

[22] Filed: Jun. 9, 1992

Related U.S. Application Data

[63] Continuation-in-part of Ser. No. 636,576, Jan. 2, 1991, abandoned.

[51] Int. Cl.[5] ..... A45D 6/00; A45D 20/50; A45D 2/36; F24H 1/06

[52] U.S. Cl. ..... 219/222; 34/97; 132/227; 132/271; 219/230; 392/383

[58] Field of Search ..... 219/222–226, 219/230; 392/379–385; 34/96–101, 95, 243 R; 132/227, 229, 228, 271

[56] References Cited

U.S. PATENT DOCUMENTS

| | | | |
|---|---|---|---|
| 1,659,118 | 2/1928 | Mims . | |
| 1,995,618 | 3/1935 | Lakenbach . | |
| 2,254,239 | 5/1939 | Norman . | |
| 3,173,429 | 3/1965 | Pauldine | 219/230 |
| 3,224,454 | 12/1965 | Quinio et al. | 219/222 X |
| 3,265,075 | 8/1966 | Edman et al. | 132/277 |
| 3,322,144 | 5/1967 | De Boer et al. | 132/271 X |
| 3,365,811 | 1/1968 | Djenner . | |
| 3,491,774 | 1/1970 | Carbone | 392/384 X |
| 3,599,345 | 8/1971 | Tolmie | 392/383 X |
| 3,890,984 | 6/1975 | Lesetar . | |
| 3,918,465 | 11/1975 | Barradas | 219/225 X |
| 4,267,851 | 5/1981 | Plaisted . | |
| 4,314,137 | 2/1982 | Dorn | 219/222 |
| 4,365,426 | 12/1982 | Suzuki et al. | 34/101 |
| 4,430,808 | 2/1984 | Toyomi et al. | 34/97 |
| 5,091,630 | 2/1992 | Djuric | 219/222 |

FOREIGN PATENT DOCUMENTS

| | | |
|---|---|---|
| 2502821 | 7/1976 | Germany . |
| 2556808 | 7/1976 | Germany . |
| 2508951 | 9/1976 | Germany . |
| 2922396 | 12/1980 | Germany . |
| 3530656 | 3/1987 | Germany . |
| 429492 | 1/1948 | Italy . |

*Primary Examiner*—Anthony Bartis
*Attorney, Agent, or Firm*—Christie, Parker & Hale

[57] ABSTRACT

A hand-held electric curling iron has a hollow elongated barrel selectively insertable sequentially into one of a plurality of different diameter cylindrical hair rollers during the process of curling hair. The barrel communicates with an electric heater-blower assembly in the curling iron handle and has a plurality of apertures along its length for delivering a stream of heated air radially outwardly into the interior of the roller for heating the hair wound thereon. Each roller is provided at its ends with projecting collars for receiving and locating the barrel within the roller with a circumferential gap between the perforated portion of the roller and the barrel. The collars have circumferential apertures which cooperate with a retaining clip on the handle for securing the roller in place during use. While the external diameter of each roller is different for making different size curls, the collars of all the rollers have the same internal diameter so that the same curling iron can be used to heat the different diameter rollers.

2 Claims, 2 Drawing Sheets

ELECTRICALLY HEATED-AIR CURLING IRON WITH A PLURALITY OF DIFFERENT DIAMETER HAIR ROLLERS USABLE THEREWITH

CROSS-REFERENCE TO RELATED APPLICATION

The present invention is a continuation-in-part of U.S. patent application Ser. No. 07/636,576, filed Jan. 2, 1991, entitled "Hair Curling Iron and Drum" now abandoned.

BACKGROUND OF THE INVENTION

The present invention relates to hair curling devices.

PRIOR ART

One well-known device for use in curling hair is a curling roller. The device includes a cylindrical roller and a cover or sleeve which is snap fit onto the roller. In use, the roller and sleeve are heated in a heating apparatus. When they have been heated, they are brought to the hair, the hair is curled around the roller, and the sleeve is fitted over the roller to retain the hair in the curled configuration. As the roller and sleeve gradually cool down, they warm the hair which then retains the curled configuration upon subsequent removal of the roller and sleeve.

There are a number of disadvantages with hair curling rollers. The principal disadvantage is that the operation of curling the hair is laborious for the hairdresser and lengthy for the person whose hair is being curled. Additionally, the results may not always be as desired. These disadvantages arise because the roller and sleeve cannot usually store sufficient heat to effect complete curling. Thus, the hairdresser must remove the cooled roller and replace it with a heated roller, and this cycle of removal and replacement must be carried out repeatedly, which is very laborious. Furthermore, during removal and replacement, some of the hairs which were curled around the roller which is being removed may escape being curled around the replacement roller, and vice versa. Additionally, in the final cycle of the operation, the hair may become overcurled.

A second well-known device for use in curling hair is a curling iron. This device comprises a perforated barrel, a housing at one end of the barrel which serves firstly as a handle for the device, and secondly contains an electrically-powered mechanism for generating a stream of hot air which is blown axially through the perforated barrel, and a retaining finger extending from the housing along the length of the barrel. In operation, the curling iron is connected to a power supply by means of an electrical lead and is brought to the hair. The retaining finger is withdrawn from the barrel, and the hair is curled around the barrel. The retaining finger is restored to its operational position to keep the hair in the curled configuration on the barrel, and the device is activated to blow hot air through the barrel to curl the hair. The curling iron may be provided with a number of different barrels, each of a different diameter, which may be readily substituted one for the other, depending on the required diameter of the curl.

Hair curling irons suffer from certain disadvantages. If a large number of curling irons are used simultaneously, then this requires considerable expenditure on curling irons, and also means that the person whose hair is being curled must bear the not inconsiderable weight of a large number of these appliances attached to their hair. If only one curling iron is used, then the operation may be quite time-consuming, because the curling iron must be used sequentially on different parts of the hair.

SUMMARY OF THE INVENTION

An object of the present invention is to provide an improved heated-air curling apparatus.

The invention provides an electrically-powered, hand-held heated-air curling iron for use with hair rollers of different external diameters to produce curls of different diameters comprising a handle, including a heater-blower assembly for producing a stream of heated air, and an elongate barrel for insertion into a hair curling roller. The barrel is hollow and has apertures defined along its length for delivering the stream of heated air radially outwardly to hair wound on the roller, and the curling iron further has retention means for retaining the barrel in position when inserted in a roller.

The invention also provides in a hair curling roller for use with a hair curling iron of the type having a handle and a barrel, an improvement wherein the hair curling roller has a perforated area on its outer circumference and has locating means for locating the barrel centrally along the axis of the roller, the internal diameter of the locating means being substantially smaller than the internal diameter of the perforated area, thereby defining a gap between the barrel and the perforated area.

In operation, the hair curling roller and sleeves are put in position in the hair in the traditional manner (but they may be cold). Then, the barrel of the hair curling iron, according to the invention, is inserted into a particular hair curling roller, located centrally by means of the locating means, retained in position by means of the retaining means, and operated to heat the hair curling roller in situ until the hair curling roller reaches the desired temperature. The barrel is then withdrawn, and the operation repeated in respect of a different curling roller.

A principal advantage of the invention relative to the use of traditional curling rollers is that the laborious removal of cooled curling rollers and replacement by heated curling rollers is eliminated. The principal advantage of the invention relative to the traditional curling iron is that only one appliance is required, and there is no need to change the barrel. Other advantages will become apparent from the description which follows.

DESCRIPTION OF THE PREFERRED EMBODIMENTS

Figure 1:
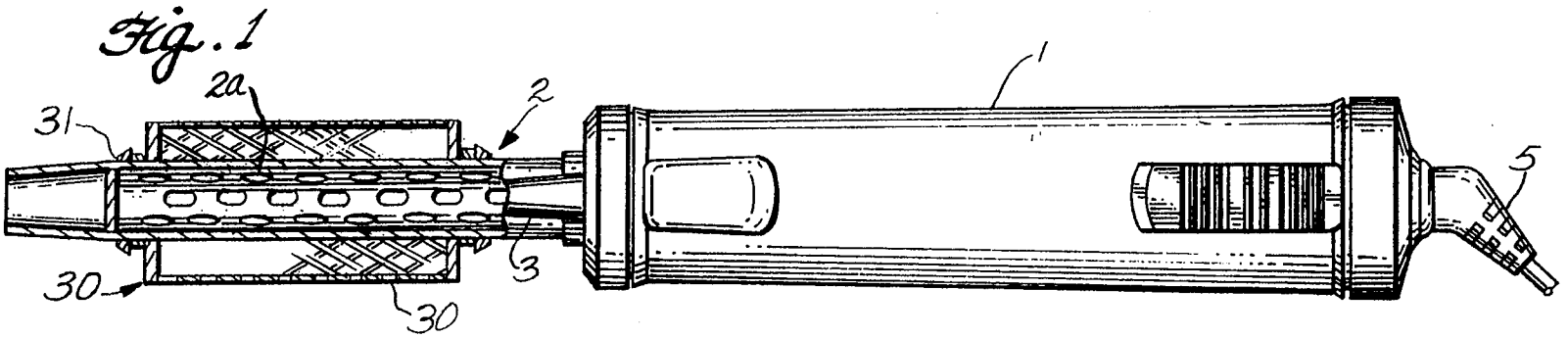
FIG. 1 is a top plan view of the curling iron.
Figure 2:
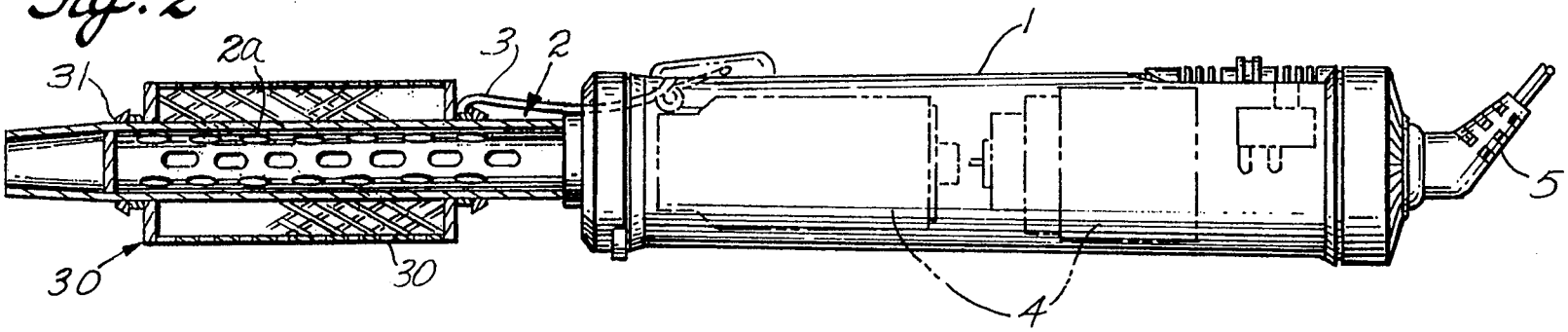
FIG. 2 is a side view of the curling iron.

Referring to FIGS. 1 and 2 of the drawings, the curling iron comprises a cylindrical housing 1, a cylindrical barrel 2 having perforations 2*a* and extending coaxially from one end of the housing, a retaining clip 3 mounted on the housing and extending from the housing a short distance along the barrel, a heater-blower assembly 4 shown by dashed lines in FIG. 2 only located within the housing for generating a high-volume stream of hot air which may be blown along the barrel and out through the perforations 2a to give an even heat distribution about the barrel, and a power supply lead 5 connected to assembly 4.

Figure 3:
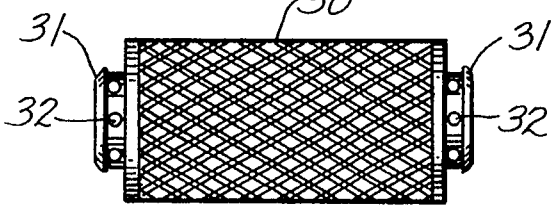
FIG. 3 is a top plan view of the curling roller for use with the curling iron.

Referring to FIG. 3 of the drawings, the curling roller 30 is made of a very heat-resistant plastic material. The curling roller 30 has a perforated area on its outer circumference. By "perforated" in this context is meant a surface provided with apertures to allow the stream of warm air to reach the hair. As illustrated in the drawing, the roller wall has a lattice structure defining perforations. The roller has an internal diameter at its perforated area substantially greater than the external diameter of the barrel 2, thereby providing a gap. The roller 30 includes a projecting collar 31 at each end thereof so as to receive and locate the barrel 2 within the roller. The collars 31 are each provided with apertures 32 for receiving the retaining clip 3. The internal diameter of each collar 31 is substantially smaller than the external diameter of the perforated area of the roller and corresponds to the external diameter of the barrel 2.

Figure 6:
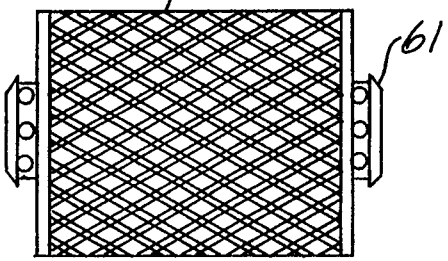
FIGS. 4, 5, and 6 are top plan views of further curling rollers of different external diameters.
Figure 5:
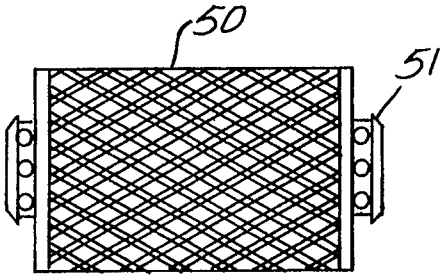
Figure 4:
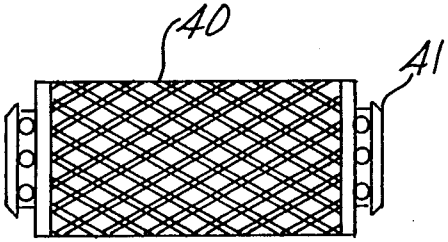

Referring to FIGS. 4, 5, and 6 of the drawings, further rollers 40, 50, and 60 are illustrated. In each case, the external diameter of the roller in the region in which the hair is wound onto the roller is different, but the diameters of the collars 31, 41, 51, and 61 are all the same.

In operation, curling rollers, such as rollers 30, 40, 50, and 60, are put in position, and the curling iron, according to the invention, is used sequentially for each roller. It will be appreciated that because the roller collars, such as 31, 41, 51, and 61, are all of the same diameter, the same curling iron may be used in relation to curling rollers of different external diameters, such as rollers 30, 40, 50, and 60.

What is claimed is:

1. In combination, an electrically-powered hand-held hair curling iron and a plurality of different diameter generally cylindrical hair rollers for sequential use therewith, wherein the hair curling iron comprises:

a handle, including a heater-blower assembly for producing a stream of heated air and an elongate barrel, for insertion into respective one of said hair curling rollers, the barrel being hollow, in communication with said heater-blower assembly, and having apertures defined along its length for delivering the stream of heated air from the heater-blower assembly radially outwardly to a roller and hair wound on the roller when inserted into the roller, and the curling iron further comprising:

retention means on said curling iron adapted to cooperate with means on the roller for retaining a selected one of said rollers in position on the barrel when the barrel is inserted in the selected one of the rollers, and wherein each roller is hollow and has a perforated area on its outer circumference and has locating means for located the barrel centrally along the longitudinal axis of the roller, the internal diameter of the locating means being substantially smaller than the internal diameter of the perforated area of the outer circumference, and wherein the external diameters of each of the rollers at the perforated areas are different from one another, by the internal diameters of the locating means are the same as one another, whereby each roller is slidable onto the barrel and can be removably held thereon by the action of the retention means and locating means for heating the rollers in situ by the heated air, whereby the iron can be removed from one roller and positioned in another roller in situ in a user's hair.

2. The combination of claim 1, wherein the locating means comprises a collar at each end of the roller, the collar having circumferential apertures, and the retention means being located between the roller and the handle, and having means for engaging in one of the apertures.

* * * * *

UNITED STATES PATENT AND TRADEMARK OFFICE

CERTIFICATE OF CORRECTION

PATENT NO. : 5,365,037

DATED : November 15, 1994

INVENTOR(S) : Wing K. Chan

It is certified that error appears in the above-indentified patent and that said Letters Patent is hereby corrected as shown below:

On the title page, insert

Assignee: change the Assignee to read as follows:

-- Dickson Industrial Co. Ltd.,
America Direct (HK) Ltd.,
Kowloon, Hong Kong --

Column 4, line 19, change "located" to -- locating --.

Column 4, line 26, after "another," change "by" to -- but --.

Signed and Sealed this

Fifth Day of September, 1995

*Attest:*

*Attesting Officer*

BRUCE LEHMAN

*Commissioner of Patents and Trademarks*